US009099829B2

(12) United States Patent
Stull

(10) Patent No.: US 9,099,829 B2
(45) Date of Patent: Aug. 4, 2015

(54) TERMINATION TOOL

(75) Inventor: David Michael Stull, Etters, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 391 days.

(21) Appl. No.: 13/544,687

(22) Filed: Jul. 9, 2012

(65) Prior Publication Data

US 2014/0007423 A1 Jan. 9, 2014

(51) Int. Cl.
*H01R 43/042* (2006.01)
*H01R 43/01* (2006.01)

(52) U.S. Cl.
CPC ..... *H01R 43/015* (2013.01); *H01R 43/042* (2013.01); *H01R 43/0421* (2013.01); *H01R 43/0424* (2013.01); *Y10T 29/5193* (2015.01); *Y10T 29/53222* (2015.01); *Y10T 29/53226* (2015.01)

(58) Field of Classification Search
CPC ..... H01R 43/00; H01R 43/015; H01R 43/04; H01R 43/042; H01R 43/0424; H01R 43/0421; Y10T 29/53226; Y10T 29/53222; Y10T 29/5193
USPC ..... 29/751, 750, 748, 747, 729, 700, 869, 29/33 M, 434, 749, 758, 861, 882, 828; 439/585, 578, 584; 72/480, 465.1, 468, 72/479, 473, 409.14; 81/177.2
See application file for complete search history.

(56) References Cited

U.S. PATENT DOCUMENTS

| | | | | |
|---|---|---|---|---|
| 3,359,779 | A | 12/1967 | Filia | |
| 4,713,874 | A | 12/1987 | Schwartz | |
| 4,742,737 | A | 5/1988 | Hatfield | |
| 5,109,591 | A * | 5/1992 | Hung | 29/566.4 |
| 7,103,968 | B2 | 9/2006 | Karrasch | |
| 2006/0230608 | A1 | 10/2006 | Caveney et al. | |

FOREIGN PATENT DOCUMENTS

| | | | |
|---|---|---|---|
| DE | 20 2007 017142 | U1 | 2/2008 |
| EP | 2068405 | A2 * | 6/2009 |
| WO | 9856081 | A1 | 12/1998 |

OTHER PUBLICATIONS

Tyco Electronics Corporation, Proper Use Guidelines, Hand Tool Holder 229755-1for Models VS-3 and MVS-3, Feb. 23, 2012, p. 1-3, Rev B, Berwyn, PA, USA.

Tyco Electronics Corporation, Proper Use Guidelines, SL Jack Tool Kit 1725150, Aug. 5, 2010, p. 1-6, Rev L, Berwyn, PA, USA.

European Search Report, Mail Date, Oct. 8, 2013, EP 13 17 5707, Application No. 13175707.2-1801.

* cited by examiner

*Primary Examiner* — Peter DungBa Vo
*Assistant Examiner* — Azm Parvez

(57) ABSTRACT

A termination tool includes a frame having a ram cavity and a connector cavity configured to receive an electrical connector therein. A driving handle is coupled to the frame and is movable between an open position and a closed position. A primary ram assembly is received in the ram cavity and is coupled to the driving handle. The primary ram assembly is configured to engage the electrical connector. A secondary ram assembly is received in the ram cavity and coupled to the driving handle. The secondary ram assembly is configured to engage the electrical connector. The primary and secondary ram assemblies are actuated by the driving handle along different primary and secondary strokes as the driving handle is moved from the open position to the closed position.

17 Claims, 5 Drawing Sheets

TERMINATION TOOL

BACKGROUND OF THE INVENTION

The subject matter herein relates generally to termination tools for terminating wires to electrical connectors.

Termination tools are known for terminating wires to electrical terminals and connectors. In some known hand tools, the connectors and wires are loaded into the termination tool and a handle is squeezed to press the connector onto the wires to make electrical connection therebetween. For example, the connector may include contacts that are pressed onto the wires to make electrical connection therebetween. The termination tools typically include a ram connected to the handle that is actuated when the handle is squeezed. The ram engages the connector and presses the contacts of the connector onto the wires.

Some known termination tools provide crimping of a component to the cable of the electrical connector. Such crimps may provide additional strain relief for the cable when attached to the connector. Typically, the crimping tool is a different tool than the tool used to make the electrical connection.

A need remains for a termination tool that allows for more complex crimping actions.

BRIEF DESCRIPTION OF THE INVENTION

In one embodiment, a termination tool is provided having a frame having a ram cavity and a connector cavity configured to receive an electrical connector therein. A driving handle is coupled to the frame and is movable between an open position and a closed position. A primary ram assembly is received in the ram cavity and is coupled to the driving handle. The primary ram assembly is configured to engage the electrical connector. A secondary ram assembly is received in the ram cavity and coupled to the driving handle. The secondary ram assembly is configured to engage the electrical connector. The primary and secondary ram assemblies are actuated by the driving handle along different primary and secondary strokes as the driving handle is moved from the open position to the closed position.

In another embodiment, a termination tool is provided having a frame having a ram cavity and a connector cavity configured to receive an electrical connector therein. A driving handle is coupled to the frame and is movable between an open position and a closed position. A primary ram assembly is received in the ram cavity and is coupled to the driving handle. The primary ram assembly is moved along a primary stroke by the driving handle. The primary ram assembly is configured to press terminals into wires of the electrical connector to make electrical connections between the wires and the terminals as the primary ram is moved along the primary stroke. A secondary ram assembly is received in the ram cavity and is coupled to the driving handle. The secondary ram assembly is moved along a secondary stroke by the driving handle where the secondary stroke is longer than the primary stroke. The secondary ram assembly is configured to crimp a strain relief to the cable of the electrical connector as the secondary ram is moved along the secondary stroke.

In a further embodiment, a termination tool is provided having a frame having a ram cavity and a connector cavity configured to receive an electrical connector therein. A driving handle is coupled to the frame at a pivot point and is movable between an open position and a closed position. A primary ram assembly is received in the ram cavity and is coupled to the driving handle. The primary ram assembly is configured to engage the electrical connector. A secondary ram assembly is received in the ram cavity and is coupled to the driving handle. The secondary ram assembly has a secondary ram configured to engage the electrical connector. The secondary ram assembly has an adjustment mechanism operatively coupled to the secondary ram. The adjustment mechanism adjusts a relative position of the secondary ram with respect to the pivot point. The primary and secondary ram assemblies are actuated by the driving handle along different primary and secondary strokes as the driving handle is moved from the open position to the closed position.

DETAILED DESCRIPTION OF THE INVENTION

Figure 1:
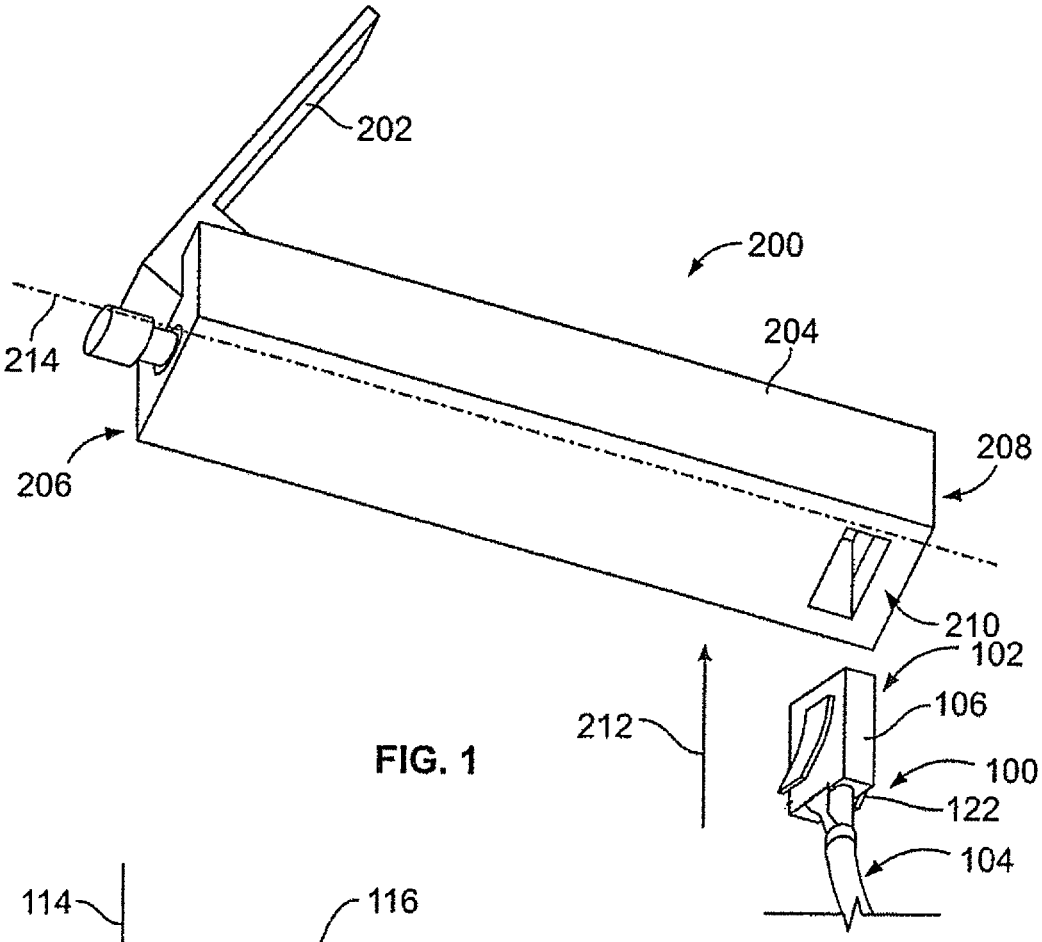
FIG. 1 is a perspective view of a termination tool formed in accordance with an exemplary embodiment for assembling an electrical connector.

FIG. 1 is a perspective view of a termination tool 200 formed in accordance with an exemplary embodiment. The termination tool 200 is used for terminating a plug 102 of an electrical connector 100 to a cable 104 of the electrical connector 100. During a termination action of the termination tool 200, a driving handle 202 of the termination tool 200 is squeezed from an open position to a closed position. Such action terminates the plug 102 to the cable 104.

In an exemplary embodiment, the termination tool 200 is used to press terminals 108 (shown in FIGS. 2 and 3) into electrical engagement with corresponding wires 110 (shown in FIG. 3) during a termination action of the termination tool 200. In an exemplary embodiment, the termination tool 200 is used to secure a strain relief 122 of the electrical connector 100 to a connector housing 106 of the electrical connector 100 during the termination action of the termination tool 200. In an exemplary embodiment, the termination tool 200 is used to terminate the strain relief 122 to the cable 104 during the termination action of the termination tool 200.

The termination tool 200 includes a frame 204 that extends between a handle end 206 and a connector end 208. The driving handle 202 is coupled to the handle end 206 of the frame 204. The driving handle 202 is pivotally coupled to the frame 204 and is movable between the open and closed positions.

The frame 204 includes an opening 210 at the connector end 208 that receives the electrical connector 100 therein. For example, both the plug 102 and cable 104 may be loaded into the termination tool 200 through the opening 210. In an exemplary embodiment, the electrical connector 100 may be loaded into the termination tool 200 in a loading direction 212. Optionally, the loading direction 212 may be generally perpendicular with respect to a longitudinal axis 214 of the termination tool 200. As the driving handle 202 is squeezed closed, the termination tool 200 acts on the electrical connector 100 to terminate the plug 102 to the cable 104 and to terminate the strain relief 122 to the plug 102 and the cable 104.

Figure 2:
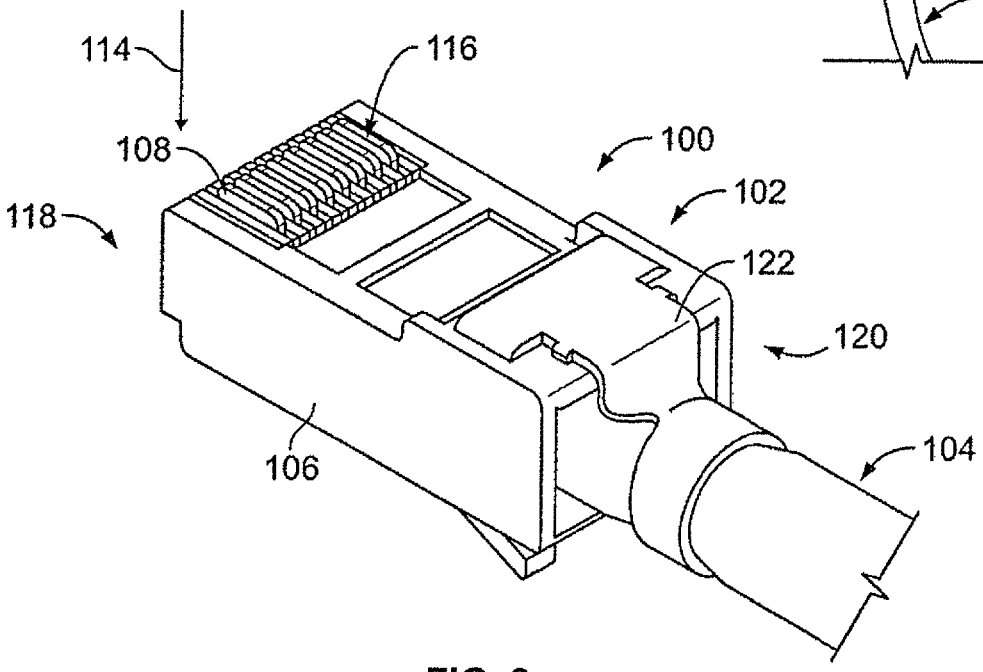
FIG. 2 is a rear perspective view of an electrical connector formed in accordance with an exemplary embodiment.
Figure 3:
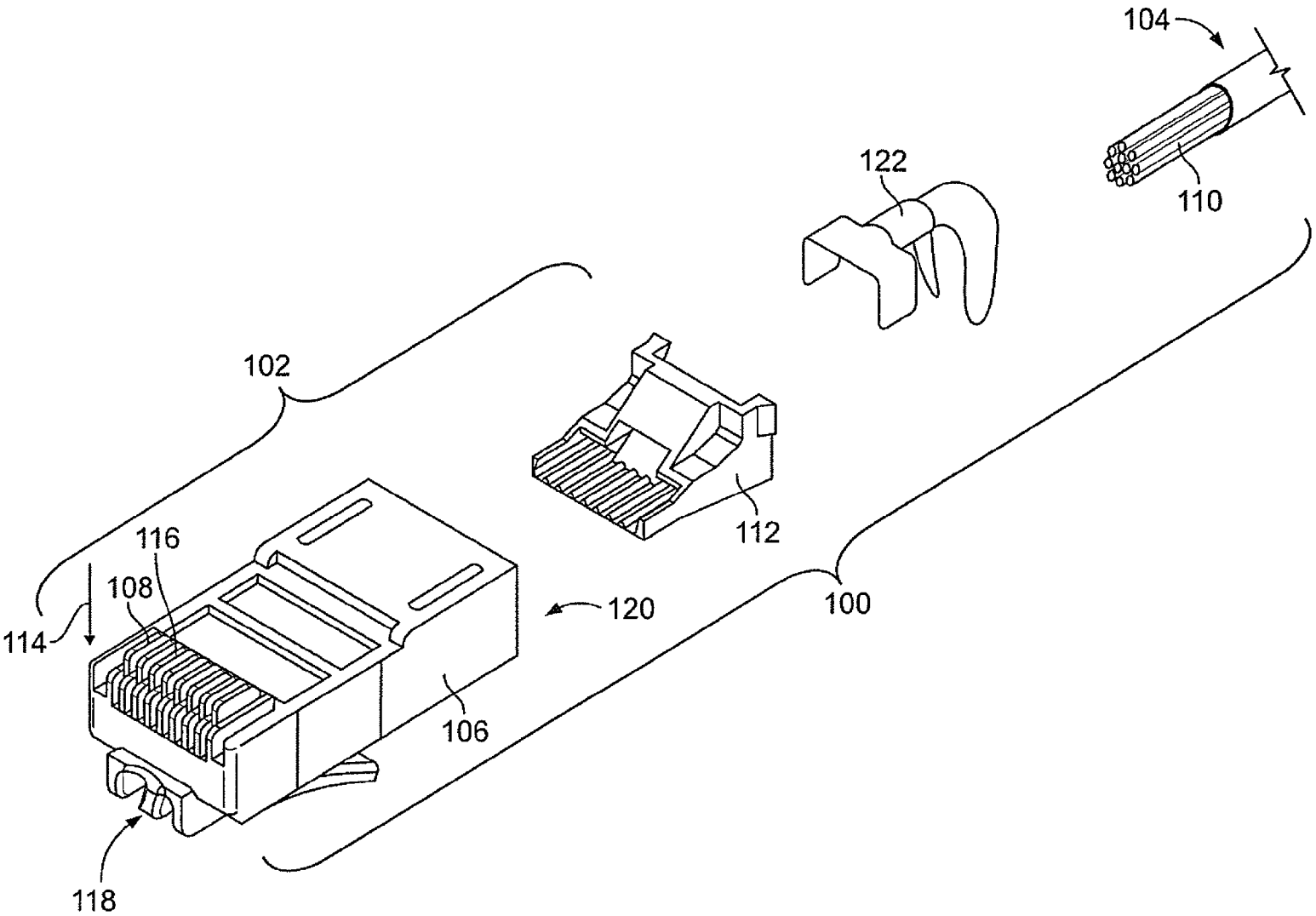
FIG. 3 is an exploded view of the electrical connector.

FIG. 2 is a rear perspective view of an electrical connector 100 formed in accordance with an exemplary embodiment. FIG. 3 is an exploded view of the electrical connector 100. The electrical connector 100 is a cable connector for use in a data communication network, such as a telecommunication system.

The electrical connector 100 includes a modular plug 102 mounted to an end of a cable 104. The termination tool 200 (shown in FIG. 1) is used to mount the modular plug 102 to the cable 104. The plug 102 includes a connector housing 106 that holds a plurality of contacts or terminals 108. The terminals 108 are configured to be connected to terminals of a mating connector, such as a modular jack (not shown). The terminals 108 are configured to be terminated to corresponding wires 110 of the cable 104. In an exemplary embodiment, the terminals 108 are pressed in a pressing direction 114 into corresponding wires 110 to make an electrical connection therebetween.

The electrical connector 100 includes a wire holder 112 that holds the individual wires 110 and that is loaded into the connector housing 106 during assembly. Once the wire holder 112 and wires 110 are positioned in the connector housing 106, the terminals 108 may be terminated to the wires 110.

In an exemplary embodiment, a termination tool, such as the termination tool 200 (shown in FIG. 1) may be used to terminate the terminals 108 to the wires 110. The terminal 108 have mating ends 116 exposed at a surface of the connector housing 106 for mating with the terminals of the modular jack. The mating ends 116 of the terminals 108 are provided proximate to a mating end 118 of the plug 102. The cable 104 extends from a cable end 120 of the plug 102.

In an exemplary embodiment, the electrical connector 100 includes a strain relief 122 coupled to the cable 104 and the connector housing 106 to provide strain relief for the cable 104. The strain relief 122 is provided at the cable end 120 of the plug 102. The strain relief 122 is coupled to the connector housing 106. In an exemplary embodiment, a termination tool, such as the termination tool 200 (shown in FIG. 1) is used to couple the strain relief 122 to the connector housing 106. The strain relief 122 is crimped to the cable 104. In an exemplary embodiment, a termination tool, such as the termination tool 200 is used to crimp the strain relief 122 to the cable 104. In an exemplary embodiment, the same termination tool 200 is used to terminate the terminals 108 to the wires 110, to crimp the strain relief 122 to the cable 104, and to couple the strain relief 122 to the connector housing 106 during a single action of the handle of the termination tool 200.

Figure 4:
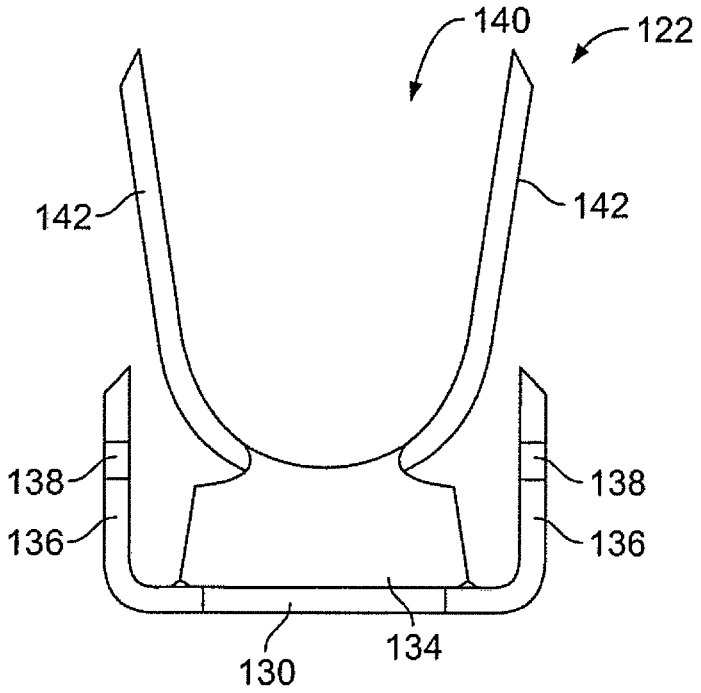
FIG. 4 is a front view of a stain relief for the electrical connector in an unformed state.
Figure 5:
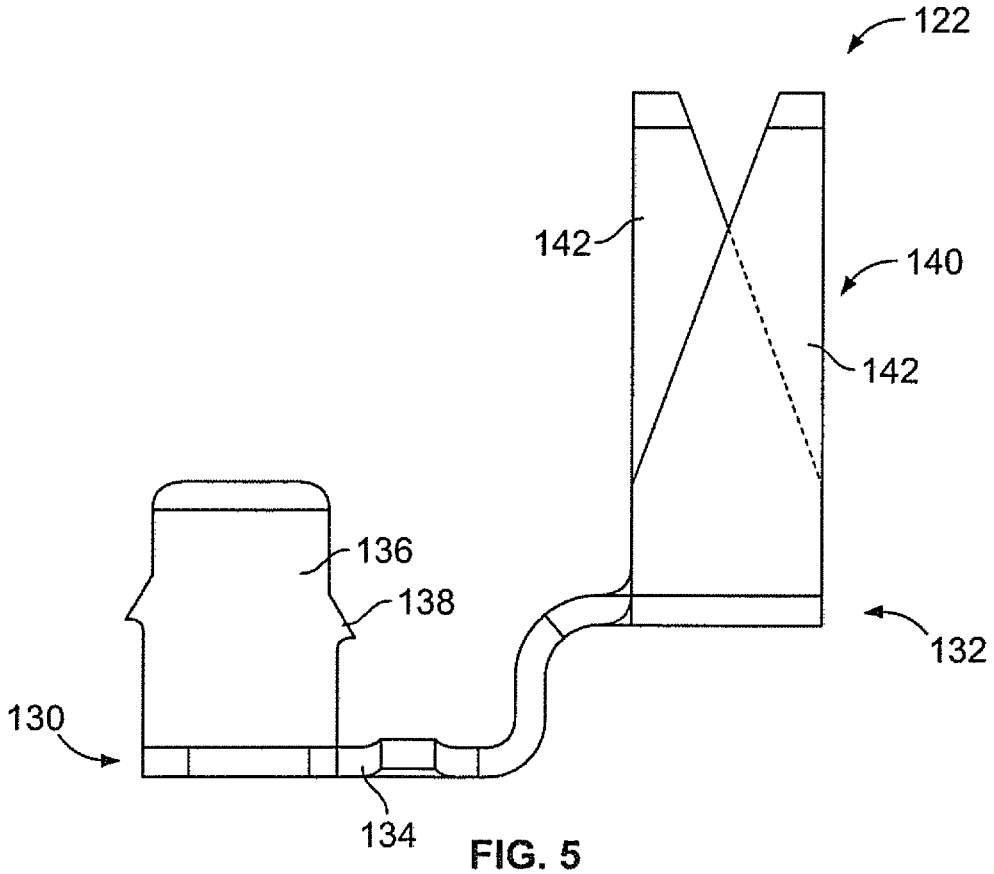
FIG. 5 is a side view of the stain relief in an unformed state.

FIG. 4 is a front view of the stain relief 122 in an unformed state. FIG. 5 is a side view of the stain relief 122 in an unformed state. The strain relief 122 extends between a connector end 130 and a cable end 132. In an exemplary embodiment, the strain relief 122 is manufactured from a metal material. The strain relief 122 is stamped and formed into the uncrimped state so that the strain relief 122 can be applied to the cable 104 and connector housing 106 using a termination tool, such as the termination tool 200 (shown in FIG. 1). The strain relief 122 may be manufactured from other materials capable of being secured to the cable 104 in alternative embodiments.

The strain relief 122 includes a main body 134 extending between the connector end 130 and the cable end 132. The strain relief 122 includes mounting tabs 136 extending from the main body 134 at the connector end 130. The mounting tabs 136 have barbs 138 extending therefrom. The mounting tabs 136 are configured to be pressed into corresponding openings and connector housing 106 (shown in FIGS. 2 and 3) to mount the strain relief 122 to the connector housing 106. The barbs 138 dig into the plastic material of the connector housing 106 to secure the strain relief 122 to the connector housing 106 and to resist pull out of the mounting tabs 136 from the openings in the connector housing 106. Other types of mounting features may be used in alternative embodiments to secure the strain relief 122 to the connector housing 106.

The strain relief 122 includes a crimp barrel 140 at the cable end 132. The crimp barrel 140 includes a pair of crimp finger 142 that may be wrapped around the cable 104 during a crimping process to secure the strain relief 122 to the cable 104. Other types of features may be used to secure the strain relief 122 to the cable 104 in alternative embodiments. In the uncrimped state, the crimp barrel 140 is generally u-shaped and is open at one side to receive the cable 104 therein.

Figure 6:
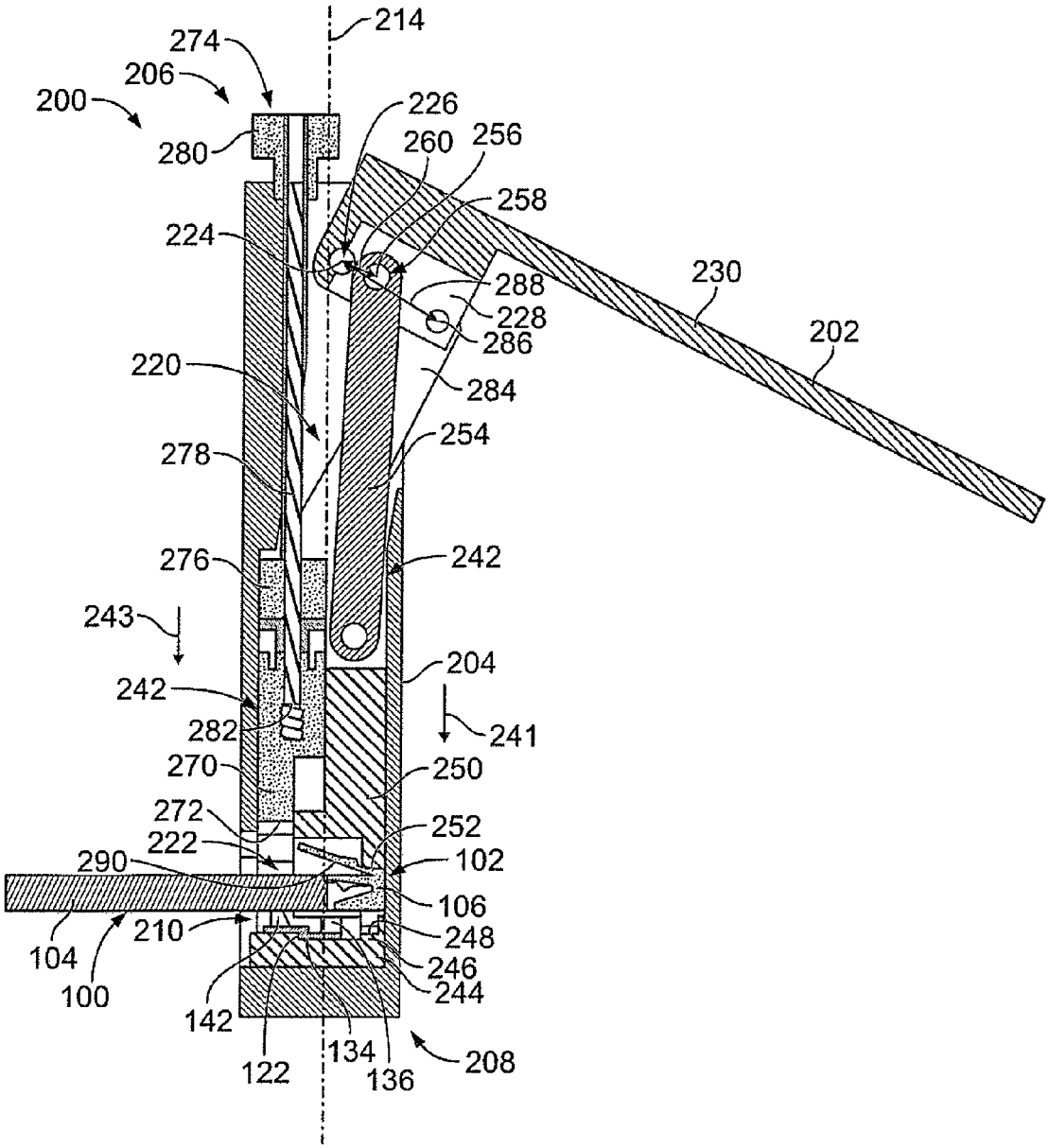
FIG. 6 is a cross sectional view of the termination tool showing a driving handle thereof in an open position.
Figure 7:
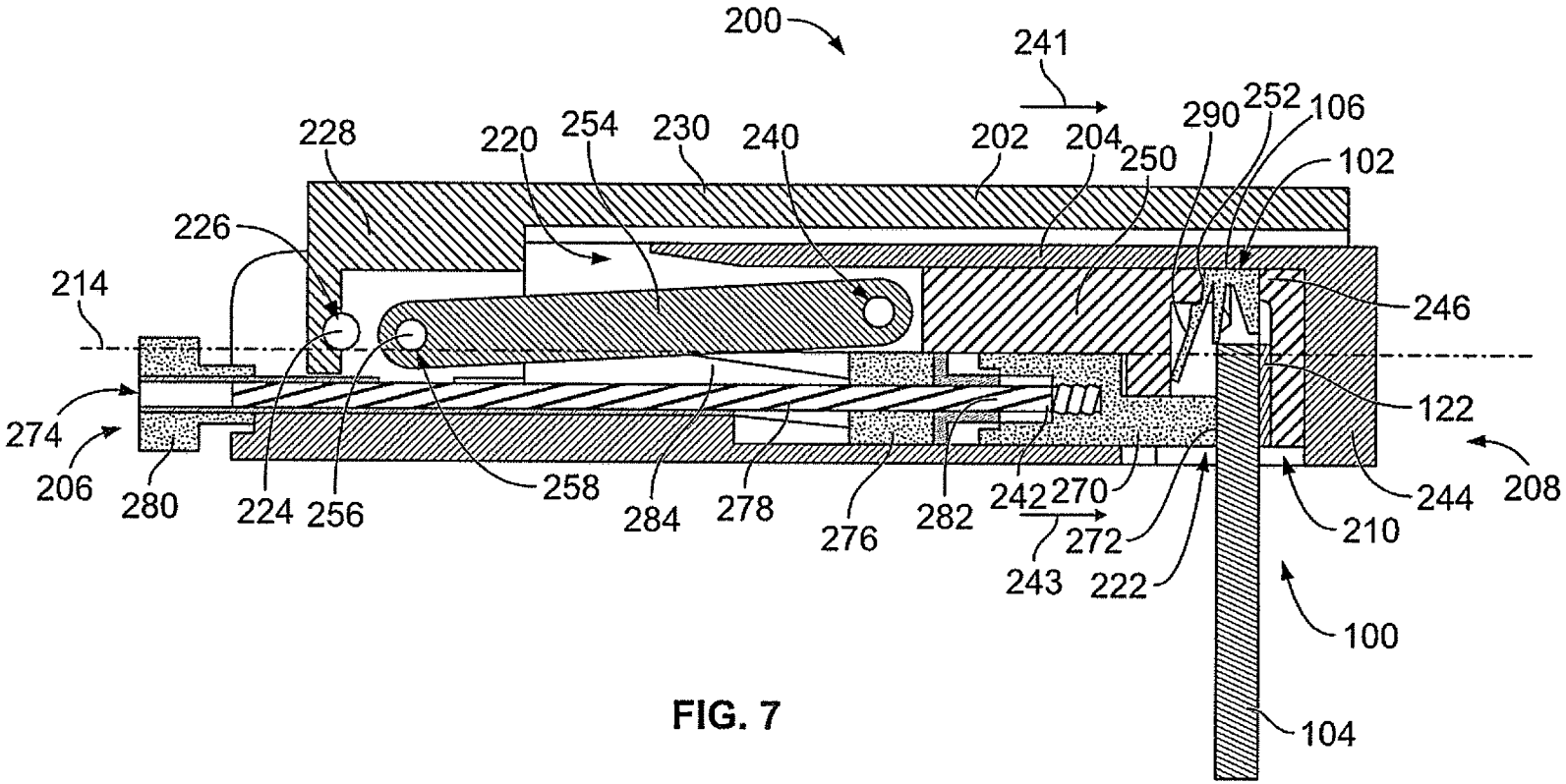
FIG. 7 is a cross section view of the termination tool showing the driving handle in a closed position.

FIG. 6 is a cross sectional view of the termination tool 200 showing the driving handle 202 in an open position. FIG. 7 is a cross section view of the termination tool 200 showing the driving handle 202 in a closed position.

The frame 204 includes a ram cavity 220 and a connector cavity 222 that receives the electrical connector 100 therein. The connector cavity 222 is accessed through the opening 210. The connector cavity 222 is positioned proximate to the connector end 208 of the termination tool 200. The ram cavity 220 is open to the connector cavity 222 such that components of the termination tool 200 can work on the electrical connector 100 within the connector cavity 222.

The driving handle 202 is coupled to the frame 204 at a pivot point 224. The driving handle 202 may include an opening 226 therethrough that receives a pin or post of the frame 204 to define the pivot point 224. The driving handle 202 includes a block 228 and a lever 230 extending from the block 228. The lever 230 provides leverage for closing the driving handle 202 by squeezing the lever 230 toward the frame 204. The driving handle 202 may extend at an acute angle with respect to the longitudinal axis 214 in the fully open position. Alternatively, the driving handle 202 may extend at approximately a right angle or may extend at an obtuse angle with respect to the longitudinal axis 214 when the driving handle 202 is fully opened.

The termination tool 200 includes a primary ram assembly 240 received in the ram cavity 220 and coupled to the driving handle 202. The primary ram assembly 240 is configured to engage the electrical connector 100 and presses against the electrical connector 100 in a pressing direction 241 when the termination tool 200 is used. The termination tool 200 includes a secondary ram assembly 242 received in the ram cavity 220 and coupled to the driving handle 202. The secondary ram assembly 242 engages the electrical connector 100 and presses against the electrical connector 100 in a pressing direction 243 during use of the termination tool 200.

The primary ram assembly 240 is actuated by the driving handle 202 along a primary stroke and the secondary ram assembly 242 is actuated by the driving handle 202 along a secondary stroke as the driving handle 202 is moved from the open position to the closed position. The primary and secondary strokes are different than one another allowing different pressing actions during the single closing action of the driving handle 202. For example, the secondary stroke may be longer than the primary stroke allowing the secondary ram assembly 242 to move along a longer path than the primary ram assembly 240.

In an exemplary embodiment, the primary ram assembly 240 is used for insertion of the terminals 108 (shown in FIGS.

2 and 3) into the connector housing 106 and may additionally be used to press the strain relief 122 into the connector housing 106, while the second ram assembly 242 is used to crimp the strain relief 122 around the cable 104. Insertion of the terminals 108 into the connector housing 106 may require only a short stroke of the primary ram assembly 240, while forming of the crimp barrel 140 (shown in FIGS. 4 and 5) around the cable 104 may require a longer stroke of the secondary ram assembly 242.

In an exemplary embodiment, the primary ram assembly 240 and the secondary ram assembly 242 are moveable within the ram cavity 220 at different rates during closing of the driving handle 202. For example, the primary ram assembly 240 may move more slowly and the secondary ram assembly 242 may move more quickly within the ram cavity 220.

In an exemplary embodiment, the termination tool 200 includes an anvil 244 received in the connector cavity 222. The electrical connector 100 is configured to be positioned between the anvil 244 and the primary and secondary ram assemblies 240, 242. The anvil 244 includes an anvil press surface 248. The electrical connector 100 may be pressed between the anvil 244 and the primary and secondary ram assembles 240, 242 during use of the termination tool 200. The anvil 244 may be used to hold the strain relief 122 while the electrical connector is loaded into the connector cavity 222. The electrical connector 100 may then be pressed onto the strain relief 122 during use of the termination tool 200. Alternatively, the strain relief 122 may be generally held as part of the electrical connector 100 and loaded into the connector cavity 222 with the plug 102 and the cable 104. The strain relief 122 may then be pressed against the anvil 244 during use of the termination tool 200. The anvil 244 includes an inserter 246 that is configured to engage the terminals 108 (shown in FIGS. 2 and 3) to press the terminals 108 into the connector housing 106 as the termination tool 200 is used.

In an exemplary embodiment, the anvil 244 is removable from the connector cavity 222 such that the anvil 244 may be replaced. For example, an anvil having a different shape or different features may be inserted into the connector cavity 222 to terminate different types of electrical connectors 100, to accommodate different styles, sizes, shapes and the like of strain reliefs 122 and/or to accommodate different size, shape, and/or number of terminals 108. Different anvils 244 may be used for terminating different components to the electrical connector 100 such as a shield or other components around the electrical connector.

The primary ram assembly 240 includes a primary ram 250 that is movable within the ram cavity 220. Optionally, the primary ram 250 may be movable in a linear direction within the ram cavity 220, such as in a direction parallel to the longitudinal axis 214. The primary ram assembly 240 includes a primary press surface 252 at an end of the primary ram 250. The primary press surface 252 engages the electrical connector 100 and presses against the electrical connector 100 during use of the termination tool 200. In the illustrated embodiment, the primary press surface 252 is configured to engage the connector housing 106 generally opposite the terminals 108 to press the connector housing 106 toward the anvil 244. In the exemplary embodiment, the primary press surface 252 includes an opening to accommodate the latch 290.

During use, as the driving handle 202 is closed, the electrical connector 100 is pressed toward the anvil 244. Pressing of the connector housing 106 presses the terminals 108 into the connector housing 106 to terminate the terminals 108 to corresponding wires 110. In an exemplary embodiment, as the primary press surface 252 presses on the connector housing 106, the mounting tabs 136 (shown in FIGS. 4 and 5) are further pressed into the connector housing 106. When the driving handle 202 is in the closed position, the main body 134 (show in FIGS. 4 and 5) is pressed against the connector housing 106 and the mounting tabs 136 are loaded into the openings in the connector housing 106 to secure the strain relief 122 to the connector housing 106.

The primary ram assembly 240 includes a primary drive link 254 extending between the primary ram 250 and the driving handle 202. In an exemplary embodiment, the primary drive link 254 is rotatable relative to the primary ram 250 and is rotatable relative to the driving handle 202. During opening and closing of the driving handle 202, the primary drive link 254 is both translated and rotated. The primary drive link 254 transfer the rotational movement of the driving handle 202 into linear movement of the primary ram 250. The primary drive link 254 is attached to the driving handle 202 at a primary pivot point 256. In an exemplary embodiment, the primary drive link 254 includes an opening proximate to an end of the primary drive link 254 that receives a pin or a post of the driving handle 202. The opening 258 and the post defined the primary pivot point 256. The primary pivot point 256 is positioned a primary moment distance 260 from the pivot point 224 of the driving handle 202. The length of the primary moment distance 260 controls the primary stroke.

The secondary ram assembly 242 includes a secondary ram 270 movable within the ram cavity 220. In an exemplary embodiment, the secondary ram 270 is movable in a linear direction within the ram cavity 220, such as in a direction parallel to the longitudinal axis 214. The secondary ram 270 includes a secondary press surface 272 that engages the electrical connector 100. In an exemplary embodiment, the secondary press surface 272 may engage the crimp barrel 140 (shown in FIGS. 4 and 5) of the strain relief 122. The secondary press surface 272 may include a cradle that receives the crimp fingers 142 (shown in FIGS. 4 and 5). The cradle may be U-shaped to form the crimp fingers 142 around the cable 104 during actuation of the termination tool 200. As the driving handle 202 closes, the electrical connector 100 is moved toward the anvil 244. The cable 104 is seated into the crimp barrel 140. Optionally, the cable 104 may be pre-loaded into the crimp barrel 140. The crimp fingers 142 are pressed and formed by the cradle defining the secondary press surface 272 around the cable 104. When the driving handle 202 is in the closed position, the crimp fingers 142 are crimped around the cable 104 to securely attach the strain relief 122 to the cable 104.

The secondary ram assembly 242 includes an adjustment mechanism 274 that is operatively coupled to the secondary ram 270. The adjustment mechanism 274 adjusts a relative position of the secondary ram 270 with respect to the driving handle 202 and/or with respect to the pivot point 224. Adjustment of the adjustment mechanism 274 may control a crimp height of the termination tool 200 for crimping the strain relief 122 to the cable 104. The adjustment mechanism 274 includes a drive block 276, an adjustment shaft 278 extending through the drive block 276 to the secondary ram 270 and an adjustment knob 280 coupled the end of the adjustment shaft 278.

During use, rotation of the adjustment knob 280 rotates the adjustment shaft 278. A distal end 282 of the adjustment shaft 278 is threaded and is threadably coupled to the secondary ram 270. Rotation of the adjustment knob 280 and adjustment shaft 278 controls a position of the secondary ram 270 with respect to the drive block 276.

The drive block 276 is coupled to the driving handle 202 by a secondary drive link 284. The secondary drive link 284 is rotatably coupled to the drive block 276 and is rotatably coupled to the driving handle 202. The secondary drive link 284 is coupled to the driving handle 202 at a secondary pivot point 286. The secondary pivot point 286 may be defined by an opening through the secondary drive link 284 that receives a pin or post extending from the driving handle 202. The secondary drive link 284 is both translated and rotated within the ram cavity 220 as the driving handle 202 is moved between the open and closed positions.

A secondary moment distance 288 is defined between the secondary pivot point 286 and the pivot point 224 of the driving handle 202. The secondary moment distance 288 is greater than the primary moment distance 260. The length of the secondary moment distance 288 controls the secondary stroke. Having the secondary moment distance 288 longer than the primary moment distance 260 allows the secondary ram assembly 242 to move along a longer stroke than the primary ram assembly 240. Having the secondary moment distance 288 longer than the primary moment distance 260 allows the secondary ram assembly 242 to move at a faster rate within the ram cavity 220 than the primary ram assembly 240.

The termination tool 200, having both the primary and secondary ram assemblies 240, 242 with different primary and secondary strokes, allows for more complex pressing and/or crimping actions than a termination tool having only a single pressing action. The dual stroke action is provided by a single closing action of a single driving handle 202. During use, the electrical connector 100 and strain relief 122 are loaded into the connector cavity 222 and positioned between the anvil 244 and the primary and secondary rams 250, 270. The driving handle 202 is closed to actuate the primary and secondary rams assemblies 240, 242.

The force generated from closing the driving handle 202 is transmitted via the primary drive link 254 to the primary ram 250, which forces the electrical connector 100 to drive into the anvil 244. The inserter 246 of the anvil 244 inserts the preloaded terminals 108 (shown in FIGS. 2 and 3) into the connector housing 106 as the electrical connector 100 is forced against the anvil 244. As the terminals 108 are pressed into the connector housing 106 the terminals 108 are terminated to corresponding wires 110 of the cable 104. For example, terminating ends of the terminals 108 are pressed onto the corresponding wires 110.

A secondary termination process is provided by the termination tool 200 to secure the cable 104 to the plug 102. The secondary ram assembly 242 provides the secondary termination process. The secondary ram 270 has a profile at the secondary press surface 272 used to form the crimp barrel 140 (shown in FIGS. 4 and 5) of the strain relief 122 to crimp the strain relief 122 to the cable 104. The secondary ram 270 moves independently from the primary ram 250, which allows the secondary ram 270 to move a different distance and at a different rate. The secondary ram 270 may be opened more quickly than the primary ram 250 as the driving handle 202 is moved from the closed position to the opened position, which allows the secondary ram 270 to move out of the way for removal of the electrical connector 100 from the connector cavity 222. For example, the secondary ram 270 may need to clear past a latch 290 of the plug 102 to prevent damage to the latch 290 as the electrical connector 100 is ejected from the connector cavity 222.

The crimp height of the secondary ram assembly 242 is controlled by the adjustment mechanism 274. The adjustment mechanism 274 allows a variable linear position the secondary ram 270, such as to accommodate different strain reliefs 122. Better crimping results are achievable by the termination tool 200 because the secondary ram assembly 242 is controllable independent of the primary ram assembly 240 and the secondary ram 242 is adjustable to accommodate different crimp heights. In alternative embodiments, the primary ram assembly 240 may additionally, or alternatively, include an adjustment mechanism for controlling the position of the primary ram 250 with respect to the driving handle 202 and the pivot point 224 of the driving handle 202.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A termination tool comprising:

an electrical connector having a connector housing and a plurality of terminals in the housing configured to be electrically connected to wires extending from the housing, the electrical connector having a strain relief coupled to the exterior of the connector housing and the cable extending from the connector housing;

a frame having a ram cavity and a connector cavity configured to receive an electrical connector therein;

a driving handle coupled to the frame and movable between an open position and a closed position;

a primary ram assembly received in the ram cavity and coupled to the driving handle, the primary ram assembly configured to engage the electrical connector and press the terminals into electrical engagement with corresponding wires during a termination action; and a secondary ram assembly received in the ram cavity and coupled to the driving handle, the secondary ram assembly configured to engage the electrical connector and terminate the strain relief to the cable behind the connector housing during the termination action;

wherein the primary and secondary ram assemblies are actuated by the driving handle along different primary and secondary strokes as the driving handle is moved from the open position to the closed position.

2. The termination tool of claim 1, wherein the secondary stroke is longer than the primary stroke.

3. The termination tool of claim 1, wherein the primary ram assembly includes a primary ram movable within the ram cavity and having a primary press surface configured to engage the electrical connector, the primary ram assembly including a primary drive link extending between the primary ram and the driving handle, the secondary ram assembly including a secondary ram movable within the ram cavity and having a secondary press surface configured to engage the electrical connector, the secondary ram assembly including a secondary drive link extending between the secondary ram and the driving handle.

4. The termination tool of claim 3, wherein the primary ram and the secondary ram are movable within the ram cavity in parallel pressing directions.

5. The termination tool of claim 1, wherein the driving handle is coupled to the frame at a pivot point, the primary ram assembly being coupled to the driving handle a primary moment distance from the pivot point, the secondary ram assembly being coupled to the driving handle a secondary moment distance from the pivot point, the secondary moment distance being longer than the primary moment distance.

6. The termination tool of claim 1, further comprising an anvil in the connector cavity, the anvil having an anvil press surface configured to engage the strain relief of the electrical connector, the secondary ram assembly having a secondary press surface configured to engage a pair of crimp fingers of the strain relief, the secondary press surface being moved toward the anvil press surface as the driving handle is moved to the closed position to crimp the strain relief between the secondary press surface and the anvil press surface, the secondary press surface bending the crimp fingers to cause the crimp fingers to wrap around the cable during the termination action.

7. The termination tool of claim 1, further comprising an anvil in the connector cavity, the anvil having an inserter configured to engage corresponding terminals of the electrical connector, the primary ram assembly being configured to press the electrical connector toward the inserter to press the terminals into electrical contact with corresponding wires of a cable of the electrical connector.

8. The termination tool of claim 1, wherein the secondary ram assembly includes a secondary ram configured to engage the electrical connector and an adjustment mechanism operatively coupled to the secondary ram, the adjustment mechanism adjusting a relative position of the secondary ram with respect to the driving handle.

9. The termination tool of claim 1, wherein the primary and secondary ram assemblies are movable within the ram cavity at different rates as the driving handle is moved between the open and closed positions.

10. The termination tool of claim 1, wherein the strain relief includes mounting tabs and the connector housing includes openings configured to receive the mounting tabs to mount the strain relief to the connector housing, the primary ram assembly is configured to press against the connector housing of the electrical connector to press the connector housing onto the strain relief causing the mounting tabs to be loaded into the openings in the connector housing during the termination action.

11. A termination tool comprising:

a frame having a ram cavity and a connector cavity configured to receive an electrical connector therein;

a driving handle coupled to the frame and movable between an open position and a closed position;

a primary ram assembly received in the ram cavity and coupled to the driving handle, the primary ram assembly moved along a primary stroke by the driving handle, the primary ram assembly configured to press terminals into corresponding wires of a cable of the electrical connector to make electrical connections between the wires and the terminals as the primary ram assembly is moved along the primary stroke; and a secondary ram assembly received in the ram cavity and coupled to the driving handle, the secondary ram assembly moved along a secondary stroke by the driving handle where the secondary stroke is longer than the primary stroke, the secondary ram assembly configured to crimp a strain relief around the cable behind the connector housing of the electrical connector as the secondary ram assembly is moved along the secondary stroke.

12. The termination tool of claim 11, wherein the secondary stroke is longer than the primary stroke.

13. The termination tool of claim 11, wherein the primary ram assembly includes a primary ram movable within the ram cavity and having a primary press surface configured to engage the electrical connector, the primary ram assembly including a primary drive link extending between the primary ram and the driving handle, the secondary ram assembly including a secondary ram movable within the ram cavity and having a secondary press surface configured to engage the electrical connector, the secondary ram assembly including a secondary drive link extending between the secondary ram and the driving handle.

14. The termination tool of claim 11, wherein the driving handle is coupled to the frame at a pivot point, the primary ram assembly being coupled to the driving handle a primary moment distance from the pivot point, the secondary ram assembly being coupled to the driving handle a secondary moment distance from the pivot point, the secondary moment distance being longer than the primary moment distance.

15. The termination tool of claim 11, further comprising an anvil in the connector cavity, the anvil having an anvil press surface configured to engage the strain relief of the electrical connector, the secondary ram assembly having a secondary press surface configured to engage the strain relief, the secondary press surface being moved toward the anvil press surface as the driving handle is moved to the closed position to crimp the strain relief between the secondary press surface and the anvil press surface.

16. The termination tool of claim 11, further comprising an anvil in the connector cavity, the anvil having an inserter configured to engage corresponding terminals of the electrical connector, the primary ram assembly being configured to press the electrical connector toward the inserter to press the terminals into electrical contact with corresponding wires of the cable of the electrical connector.

17. The termination tool of claim 11, wherein the secondary ram assembly includes a secondary ram configured to engage the electrical connector and an adjustment mechanism operatively coupled to the secondary ram, the adjustment mechanism adjusting a relative position of the secondary ram with respect to the driving handle.

* * * * *